US010900244B2

(12) United States Patent
Vierkotten et al.

(10) Patent No.: US 10,900,244 B2
(45) Date of Patent: Jan. 26, 2021

(54) ELECTROHYDRAULIC CONTROL CIRCUIT FOR A LARGE MANIPULATOR

(71) Applicant: Schwing GmbH, Herne (DE)

(72) Inventors: Reiner Vierkotten, Oberhausen (DE); Johannes Henikl, Essen (DE); Andreas Lehmann, Moers (DE); Peter Przebinda, Datteln (DE); Karl-Heinz Schwedhelm, Castrop-Rauxel (DE)

(73) Assignee: SCHWING GMBH, Herne (DE)

( * ) Notice: Subject to any disclaimer, the term of this patent is extended or adjusted under 35 U.S.C. 154(b) by 57 days.

(21) Appl. No.: 16/092,539

(22) PCT Filed: Apr. 10, 2017

(86) PCT No.: PCT/EP2017/058510
§ 371 (c)(1),
(2) Date: Oct. 10, 2018

(87) PCT Pub. No.: WO2017/178413
PCT Pub. Date: Oct. 19, 2017

(65) Prior Publication Data

US 2019/0119934 A1 Apr. 25, 2019

(30) Foreign Application Priority Data

Apr. 11, 2016 (DE) ..... 10 2016 106 616

(51) Int. Cl.
*F15B 13/10* (2006.01)
*E04G 21/04* (2006.01)
(Continued)

(52) U.S. Cl.
CPC ..... *E04G 21/0436* (2013.01); *E04G 21/0445* (2013.01); *F15B 15/202* (2013.01);
(Continued)

(58) Field of Classification Search
CPC ..... F15B 13/10; F15B 2211/8757; E04G 21/0445
See application file for complete search history.

(56) References Cited

U.S. PATENT DOCUMENTS 4,811,561 A * 3/1989 Edwards ..... G05B 19/414 340/3.1
6,282,893 B1 9/2001 Porter et al.
(Continued)

FOREIGN PATENT DOCUMENTS

CN 201924601 U 8/2011
CN 104863366 A 8/2015
(Continued)

*Primary Examiner* — F Daniel Lopez
(74) *Attorney, Agent, or Firm* — Faegre Drinker Biddle & Reath LLP

(57) ABSTRACT

An electrohydraulic control circuit includes a hydraulically-operated drive assembly and an emergency valve. The hydraulically-operated drive assembly includes an electrically-actuated proportional valve and hydraulic operating lines. The proportional valve is connected to the hydraulic operating lines for actuation of the drive assembly in a normal operation mode. The proportional valve is also connected to a pressure supply line and to a return line. The emergency valve is connected to the hydraulic operating lines for actuation of the drive assembly in an emergency operation mode. In the emergency operation mode, the emergency valve is actuated via an emergency operating unit.

20 Claims, 5 Drawing Sheets

Figure 1:
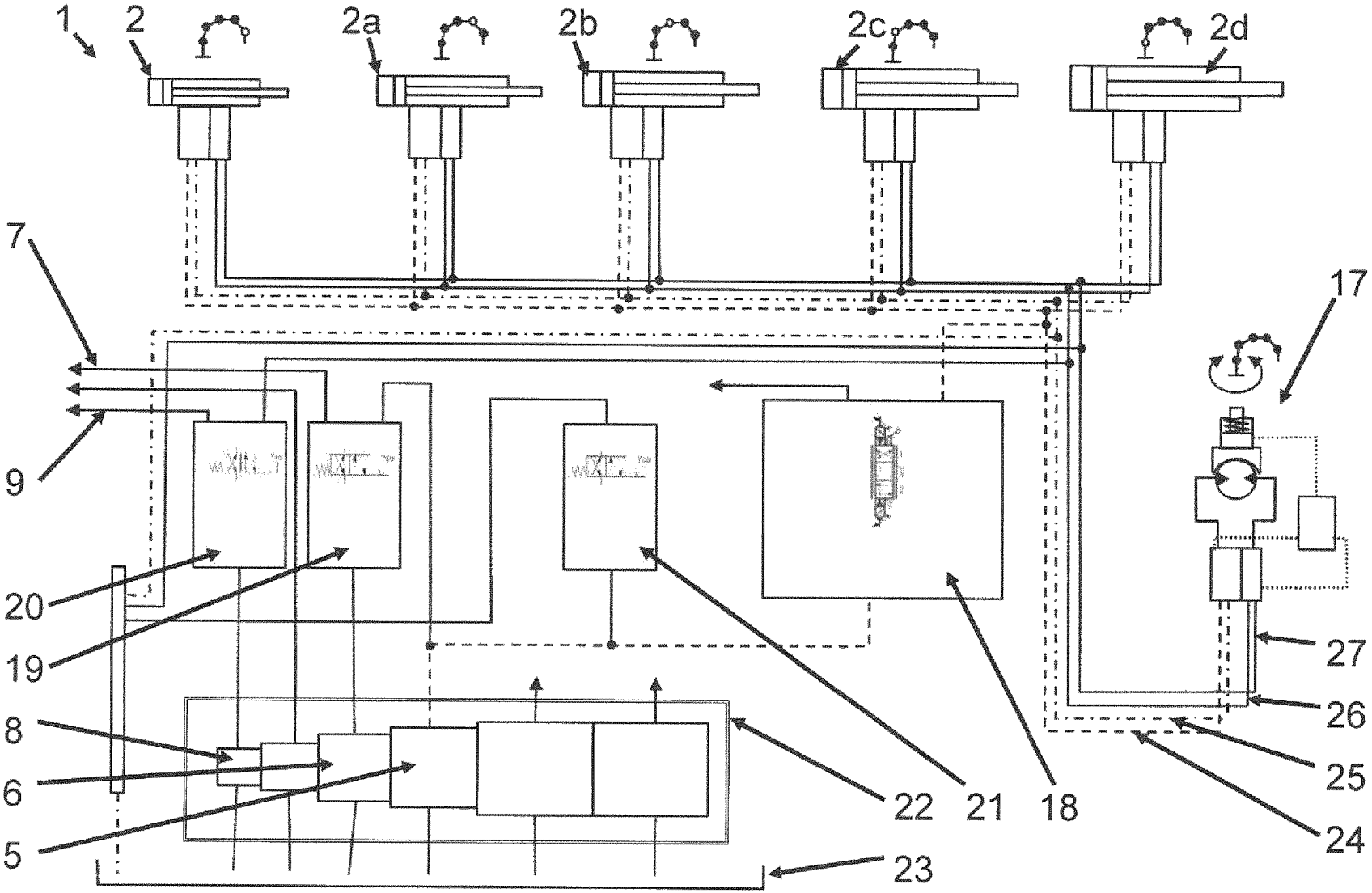

(51) Int. Cl.
*F15B 15/20* (2006.01)
*F15B 20/00* (2006.01)

(52) U.S. Cl.
CPC ..... *F15B 20/00* (2013.01); *F15B 13/10* (2013.01); *F15B 2211/20576* (2013.01); *F15B 2211/30515* (2013.01); *F15B 2211/30565* (2013.01); *F15B 2211/6313* (2013.01); *F15B 2211/8633* (2013.01); *F15B 2211/8636* (2013.01); *F15B 2211/8757* (2013.01)

(56) References Cited

U.S. PATENT DOCUMENTS

| | | | | |
|---|---|---|---|---|
| 6,702,701 | B2 * | 3/2004 | Phelan | F16H 48/10 475/107 |
| 2011/0179783 | A1 * | 7/2011 | Pirri | E02F 9/2207 60/420 |
| 2016/0084270 | A1 * | 3/2016 | Specks | E04G 21/0436 60/445 |

FOREIGN PATENT DOCUMENTS

| | | | |
|---|---|---|---|
| DE | 202007008628 | U1 | 12/2018 |
| EP | 2347988 | A1 | 7/2011 |
| WO | 2014165888 | A1 | 10/2014 |

* cited by examiner

ELECTROHYDRAULIC CONTROL CIRCUIT FOR A LARGE MANIPULATOR

CROSS-REFERENCE TO RELATED APPLICATION

This application is a U.S. 371 Application of International Application No. PCT/EP2017/058510, filed Apr. 10, 2017, which claims priority to Germany Patent Application No. 10 2016 106 616.8, filed Apr. 11, 2016, both of which are herein incorporated by reference in their entireties.

The invention relates to an electrohydraulic control circuit for actuating a hydraulically operated drive assembly, by means of which the orientation of a mast segment of a manipulator, in particular of a large manipulator for truck-mounted concrete pumps, can be adjusted, having an electrically actuated proportional valve, which is connected to hydraulic operating lines of the drive assembly for its actuation in normal operation, wherein the proportional valve is connected to a pressure supply line, wherein for emergency operation an emergency valve is connected to the hydraulic operating lines of the drive assembly for its actuation during emergency operation, and wherein the proportional valve (28) and the emergency valve (36) are arranged directly on the associated drive assembly (2, 2*a*, 2*b*, 2*c*, 2*d*) to be controlled.

Moreover, the invention relates to a manipulator, in particular a large manipulator for truck-mounted concrete pumps, having such a control circuit.

Such an electrohydraulic control circuit is known from WO 2014/165888 A1. This document does not disclose any possibility of safely actuating the emergency valves upon failure of the electronics or the hydraulics for the normal operation so that the manipulator cannot be controlled by the emergency valves for a salvaging or repair. Furthermore, a common return line is disclosed for the normal operation and the emergency operation. If this return line develops a leak, an emergency operation would not be possible. Furthermore, an emergency operation is likewise not possible if the pressure supply unit fails, which is connected to the pressure supply line. A further drawback to the disclosed control circuit is that a separate control oil circuit is provided for the opening and closing of the hydraulically releasable nonreturn valves and for supplying the hydraulically pilot-operated proportional valves. In this way, a further pressure supply line and tank line are needed for this control oil circuit.

The problem which the invention proposes to solve is therefore to indicate a control circuit as well as a manipulator which remedies the described drawbacks and makes possible a safer emergency operation upon failure of the regular control circuit components.

This problem is solved by the claimed electrohydraulic control circuit.

According to the invention, it is proposed that in emergency operation, the emergency valve is actuated via an emergency operating unit. This has the special advantage that, in event of failure or problems with the normal control system which operates the proportional valves, the drive assemblies can still be operated safely via the emergency valves, for example in order to salvage the articulated mast even after the failure of the mast hydraulics for the normal operation or failure of the electrical control system. Preferably, during emergency operation the emergency valve is electrically actuated via an emergency operating unit. In this way, a reliable actuation is possible during emergency operation.

One advantageous embodiment proposes that the proportional valve and the emergency valve are arranged directly on the associated drive assembly to be controlled. The relatively short hydraulic connection lines in this way result in a more sensitive actuation of the drive assemblies. In the usual arrangement of the proportional valves for the control system of the drive assemblies of a large manipulator in a centrally arranged control block, situated on the other side from the drive assemblies, the proportional valves are connected by relatively long hydraulic lines to the drive assemblies. Because hose breakage or the like cannot be ruled out in this arrangement, lowering brake valves are usually situated at the drive assemblies, which prevent a lowering of the large manipulator in the event of a fault. These lowering brake valves in the machinery of the prior art first need to be pressurized by the hydraulic pressure before a reaction of the drive assembly can occur; due to the long hydraulic lines or hoses, this results in a greatly delayed response behavior of the drive assemblies. In the case of the arrangement of the proportional valve at or near the drive assembly, the hydraulic hoses between the proportional valve and the drive assembly can be eliminated and the lowering brake valves can be replaced by nonreturn valves with a comparatively faster response behavior, so that the reaction of the drive assembly to positioning commands of the proportional valve is further improved.

One advantageous embodiment proposes that the emergency operating unit is connected to the voltage supply and to the emergency valve, preferably by cable. This ensures that the manipulator can be safely controlled during emergency operation by simple, preferably electrical connections, for example without the availability of the usually present wireless radio remote control system for the actuation of the proportional valves for the normal operation or an electronic mast control system.

One especially advantageous embodiment proposes that the emergency operating unit is connected by a movable cable to the voltage supply and to the emergency valve, preferably by cable. In this way, the operator with the emergency operating unit can move further away from the machine in order to see the position of the mast during the emergency operation. This further ensures a safe control system for the articulated mast even during emergency operation.

It is further advantageous that the voltage supply provides a constant voltage and the emergency valve is actuated with this constant voltage. This ensures in easy manner that the manipulator during emergency operation can be operated with a simple, not necessarily regulated voltage supply during emergency operation.

One advantageous embodiment proposes that the emergency operating unit is activated for the emergency operation with a key switch, so that an unintentional or unauthorized activation of the emergency operation is not possible.

It is further advantageous that switches and/or buttons are arranged on the emergency operating unit, by which the emergency valve can be supplied with voltage by activating the switches and/or buttons, in order to move the corresponding drive assembly. This makes possible a simple and robust actuation of the drive assemblies even during emergency operation.

It is further advantageous that the proportional valve (28) can be actuated with a step motor. This produces a more secure electrohydraulic control circuit, ensuring an excellent response behavior of the mast segments. Furthermore, proportional valves actuatable with a step motor are much lighter and smaller than equally powerful valves with proportional magnets, making possible a substantial weight saving and a reduction of the necessary design space. Since the proportional valve with step motor furthermore is not a hydraulically pilot-controlled valve, the need for a separate control oil circuit is also eliminated in this embodiment of the invention, so that the number of hydraulic lines on the mast segments is reduced, which likewise accomplishes a distinct weight saving.

It is of special advantage that the step motor of the proportional valve can be actuated via a BUS data link. In this way, substantial weight can be saved as compared to a hydraulic pilot control system of the valve. This is of special interest, because it can realize the continual desire for a larger range of large manipulators.

It is further advantageous that a local control mechanism (ECU) is arranged on the drive assembly to receive BUS data signals and to control the step motor of the proportional valve. With such a local control mechanism (ECU), the step motor can be controlled especially fast and precisely by exact setting of the positioning steps. Another advantage of the local control mechanism is that information can be processed locally and therefore the number of electrical lines on the articulated mast and the workload of the CAN bus system can be reduced to a minimum. Advantageously a voltage supply of the outputs of the control mechanism is switched off during a changeover to the emergency operation. This guarantees that the (safety-relevant) valves actuated by the local control mechanism are placed in a safe condition.

It is of special advantage that several separate voltage supplies lead to the local control mechanism (ECU), wherein at least a first voltage supply supplies the local control mechanism (ECU), more precisely its computing units, and at least a second voltage supply supplies the outputs at the local control mechanism (ECU). In this way, the outputs of the local control mechanism (ECU), which may be connected to safety-relevant valves, can be switched off independently of the computing units of the local control mechanism (ECU). Hence, in event of a failure, a more secure condition of the system can be assured, in which the computing units of the local control mechanism (ECU) can always still process data, for example, in order to make possible the polling of locally connected sensors and the relaying of the measurement values to a central control system.

One especially advantageous embodiment proposes that the first voltage supply is interrupted during changeover to the emergency operation and/or the second voltage supply remains activated. The interrupting of the first voltage supply results in a switching off of the control mechanism (ECU), so that certain faults can be worked around in this way. The activation of the second voltage supply furthermore makes possible an actuating of the drive assemblies. But it may also be advantageous not to interrupt the first voltage supply, so that the sensors connected to the control mechanism (ECU) continue to deliver information and the control mechanism (ECU) keeps a record of this.

It is especially advantageous that the emergency valve is automatically activated at periodic intervals. This may occur, for example, when the control circuit or the manipulator is placed in operation and the mast is still located in a support, for example. With this automatic activating of the valves, it can be assured that they also have not become stuck due to long lack of use. For this activation, the control mechanism further has a control output for the emergency valve, which is cut off preferably by a diode circuit from the second voltage supply.

Further advantageous is an embodiment in which nonreturn valves switched upstream and/or downstream of the proportional valve are relieved in the emergency operation. This prevents the nonreturn valves from opening, since not insignificant dynamic pressures may occur in the case of large delivery amounts of hydraulic oil, especially when the articulated mast is moving, depending on the particular cross section of the return lines used.

One embodiment of the invention proposes that the proportional valve and/or a switching valve and/or at least one nonreturn valve is switched to a safe condition upon failure of the voltage supply, especially upon failure of the voltage supplies. In this way, it can be ensured that the manipulator does not move and stays in its current position upon failure of the voltage supply.

According to the invention, it is alternatively or additionally proposed that the emergency valve is connected to a further pressure return line, while the proportional valve is connected to another, regular return line. In this way, the drive assembly can be controlled via the emergency valve, even if the regular return line has a fault or a leak. The return of the hydraulic oil to the tank via separate return lines makes the control circuit less prone to faults.

According to the invention, it is alternatively or additionally proposed that the further pressure supply line is connected to an emergency pressure supply unit, while the other pressure supply line is connected to another pressure supply unit. In this way, the drive assembly can be safely driven during emergency operation, even if the regular pressure supply unit fails. The use of a separate emergency pressure supply unit makes the control circuit more fault-tolerant.

One advantageous embodiment proposes that the proportional valve and the emergency valve are arranged directly on the associated drive assembly to be controlled. The relatively short hydraulic connection lines in this way result in a more sensitive actuation of the drive assemblies. In the usual arrangement of the proportional valves for the control system of the drive assemblies of a large manipulator in a centrally arranged control block, situated on the other side from the drive assemblies, the proportional valves are connected by relatively long hydraulic lines to the drive assemblies. Because hose breakage or the like cannot be ruled out in this arrangement, lowering brake valves are usually situated at the drive assemblies, which prevent a lowering of the large manipulator in event of a fault. These lowering brake valves in the machinery of the prior art first need to be pressurized by the hydraulic pressure before a reaction of the drive assembly can occur; due to the long hydraulic lines or hoses, this results in a greatly delayed response behavior of the drive assemblies. In the case of the arrangement of the proportional valve at or near the drive assembly, the hydraulic hoses between the proportional valve and the drive assembly can be eliminated and the lowering brake valves can be replaced by nonreturn valves with a comparatively faster actuating behavior, so that the reaction of the drive assembly to positioning commands of the proportional valve is further improved.

It is further advantageous that the proportional valve can be actuated with a step motor. This produces a more secure electrohydraulic control circuit, ensuring an excellent response behavior of the mast segments. Furthermore, proportional valves actuatable with a step motor are much lighter and smaller than equally powerful valves with proportional magnets, making possible a substantial weight saving and a reduction of the necessary design space. Since the proportional valve with step motor furthermore is not a hydraulically pilot-controlled valve, the need for a separate control oil circuit is also eliminated in this embodiment of the invention, so that the number of hydraulic lines on the mast segments is reduced, which likewise accomplishes a distinct weight savings.

It is of special advantage that the step motor of the proportional valve can be actuated via a BUS data link. In this way, substantial weight can be saved as compared to a hydraulic pilot control system of the valve. This is of special interest, because it can realize the continual desire for a larger range of large manipulators.

It is further advantageous that a local control mechanism (ECU) can be arranged on the drive assembly to receive BUS data signals and to control the step motor of the proportional valve. With such a local control mechanism (ECU), the step motor can be controlled especially fast and precisely by exact setting of the positioning steps. Another advantage of the local control mechanism is that information can be processed locally and therefore the number of electrical lines on the articulated mast and the workload of the CAN bus system can be reduced to a minimum.

Advantageously a voltage supply of the outputs of the local control mechanism (ECU) is switched off during a changeover to the emergency operation. This guarantees that the (safety-relevant) valves actuated by the local control mechanism are placed in a safe condition.

It is of special advantage that several separate voltage supplies may lead to the local control mechanism (ECU), wherein at least a first voltage supply supplies the local control mechanism (ECU), more precisely its computing units, and at least a second voltage supply supplies the outputs at the local control mechanism (ECU). In this way, the outputs of the local control mechanism (ECU), which may be connected to safety-relevant valves, can be switched off independently of the computing units of the local control mechanism (ECU). Hence, in event of a failure, a more secure condition of the system can be assured, in which the computing units of the local control mechanism (ECU) can always still process data, for example, in order to make possible the polling of locally connected sensors and the relaying of the measurement values to a central control system.

One especially advantageous embodiment proposes that the first voltage supply is interrupted during changeover to the emergency operation and/or the second voltage supply remains activated. The interrupting of the first voltage supply results in a switching off of the control mechanism (ECU), so that certain faults can be worked around in this way. The activation of the second voltage supply furthermore makes possible an actuating of the drive assemblies. However, it may also be advantageous not to interrupt the first voltage supply, so that the sensors connected to the control mechanism (ECU) continue to deliver information and the control mechanism (ECU) keeps a record of this.

Further advantageous is an embodiment in which nonreturn valves switched upstream and/or downstream of the proportional valve are relieved in the emergency operation. This prevents the nonreturn valves from opening, since not insignificant dynamic pressures may occur in the case of large delivery amounts of hydraulic oil, especially when the articulated mast is moving, depending on the particular cross section of the return lines.

One advantageous embodiment proposes that the emergency pressure supply unit in normal operation is designed for the pressure supply of another pressure receiver used in normal operation. This may be, for example, a water pump for a high-pressure cleaner, since this unit is ordinarily not used during emergency operation and therefore it is available for the drive in the emergency operation. This multiple use in both normal operation and emergency operation saves weight and reduces the number of components required.

Especially advantageous is an embodiment in which die emergency pressure supply unit in normal operation is used for the pressure supply of an agitator. The agitator in normal operation is driven by a hydraulic motor and stirs the liquid concrete in the feeding hopper of a concrete pump, so that the concrete after being filled by a mixer truck does not solidify in the feeding hopper and it can be better delivered to the suction openings of the delivery cylinder. For the emergency operation of the manipulator, the emergency pressure supply unit is simply switched over.

One embodiment of the invention proposes that the proportional valve and/or a switching valve and/or at least one nonreturn valve is switched to a safe condition upon failure of the voltage supply, especially upon failure of the voltage supplies. In this way, it can be ensured that the manipulator does not move and stays in its current position upon failure of the voltage supply.

It is especially advantageous that the emergency valve is automatically activated at periodic intervals. This may occur, for example, when the control circuit or the manipulator are placed in operation and the mast is still located in a support, for example. With this automatic activating of the valves, it can be assured that they also have not become stuck due to long lack of use. For this activation, the control mechanism further has a control output for the emergency valve, which is cut off preferably by a diode circuit from the second voltage supply.

It is further advantageous that the nonreturn valves are relieved via the further return line for their closing. This allows the use of smaller cross sections for the regular return line, since the nonreturn valves thus can remain safely closed even at large dynamic pressures. A smaller cross section for the return line further affords potential in reducing the overall weight of the control circuit or the manipulator.

A further subject matter of the invention is a manipulator, in particular a large manipulator for truck-mounted concrete pumps, with a foldout articulated mast, having a turntable rotatable about a vertical axis and a plurality of mast segments, wherein the mast segments can swivel in limited manner at bending joints each time around bending axes with respect to a neighboring mast segment or the turntable by means of a respective drive assembly, wherein an electrohydraulic control circuit as described above and in the following is provided for the control of the drive assembly. A manipulator with such a control circuit enables a safer emergency operation upon failure of the regular control circuit components.

One advantageous embodiment of this manipulator proposes that the proportional valve is arranged directly on the associated drive assembly to be controlled, that is, at the place where the drive assembly is situated. Due to the especially small size and low weight of the proportional valve according to the invention, it is especially suitable for a decentralized hydraulic control circuit. Thus, the proportional valve may be arranged at the drive assembly being controlled so that the proportional valve together with the drive assembly on to the mast segment of the articulated mast changes its position relative to the turntable or the concrete pump. Thanks to the direct arrangement of the proportional valve on the associated drive assembly to be controlled, the length of the operating lines can be significantly reduced, so that the response behavior of the manipulator is improved and allows it to move in a more nimble and dynamic way.

Figure 2:
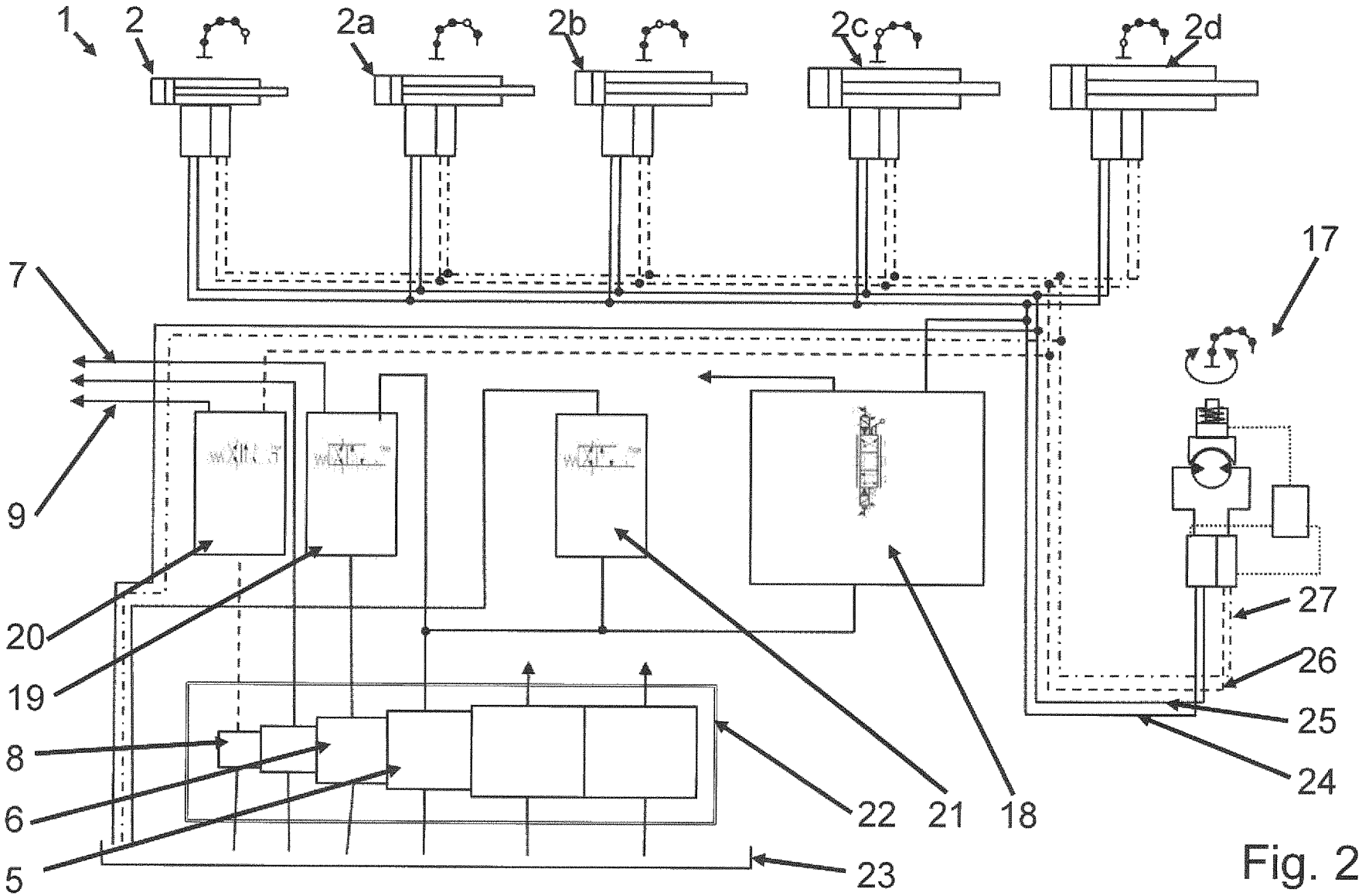
Figure 3:
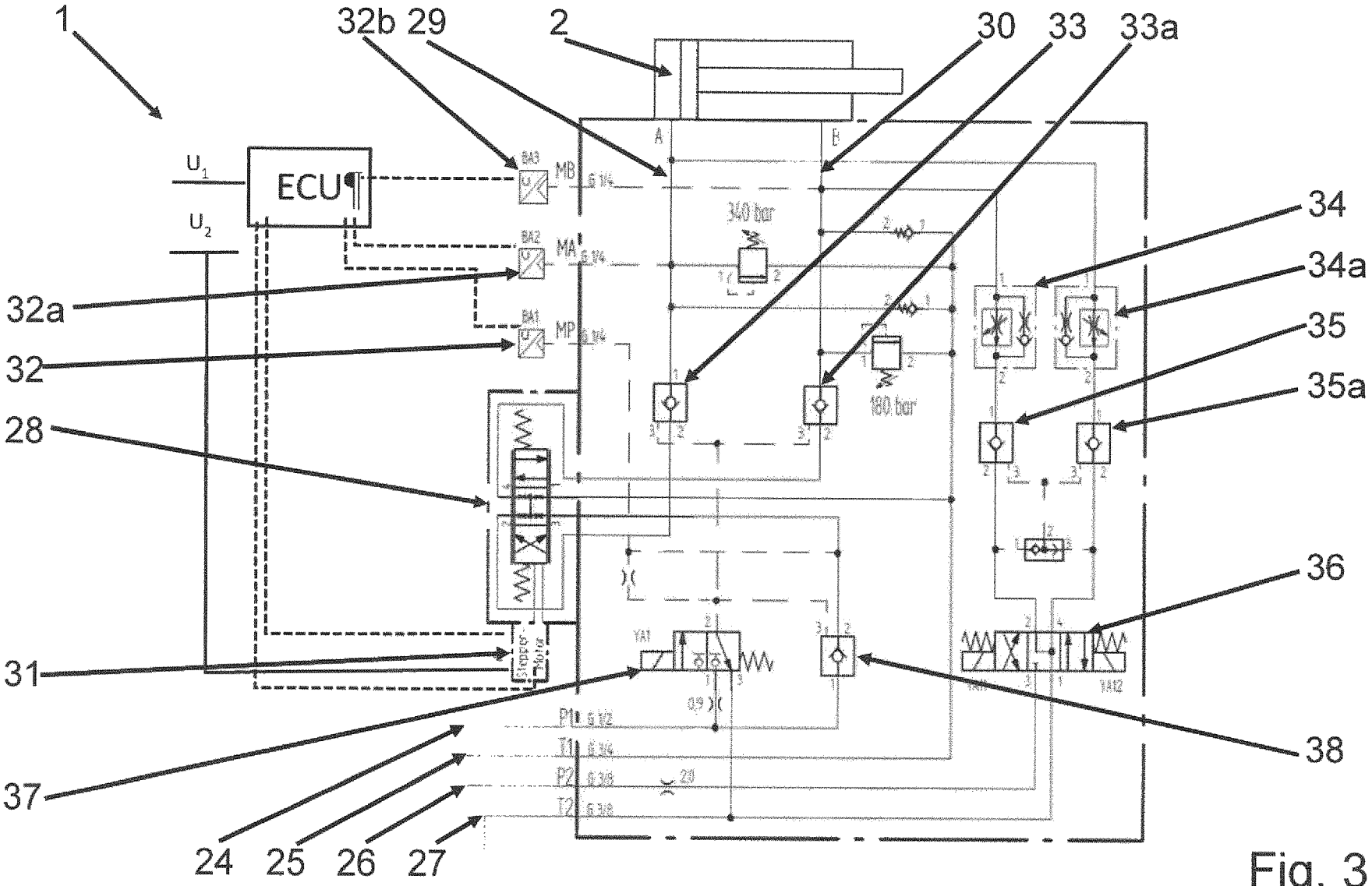
Figure 4:
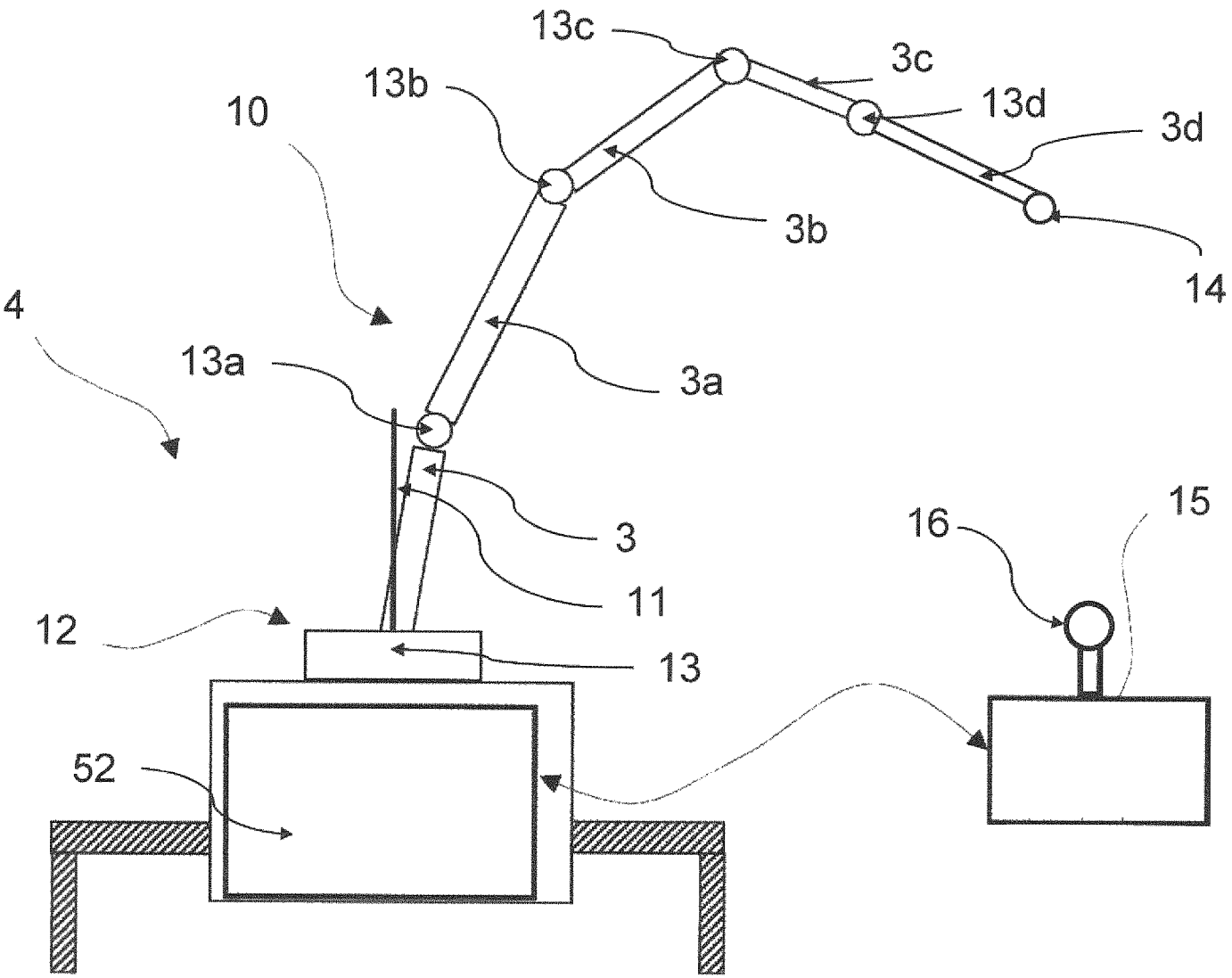

Further features, details and advantages of the invention will emerge from the following description as well as the drawings. A sample embodiment of the invention is show purely schematically in the following drawings and shall be described more closely below. Objects corresponding to each other are given the same reference numbers in all the figures. There are shown:

FIGS. 1 and 2: a hydraulic control circuit according to the invention;

FIG. 3: a circuit diagram of a control circuit for an individual drive assembly;

FIG. 4: a manipulator according to the invention

Figure 5:
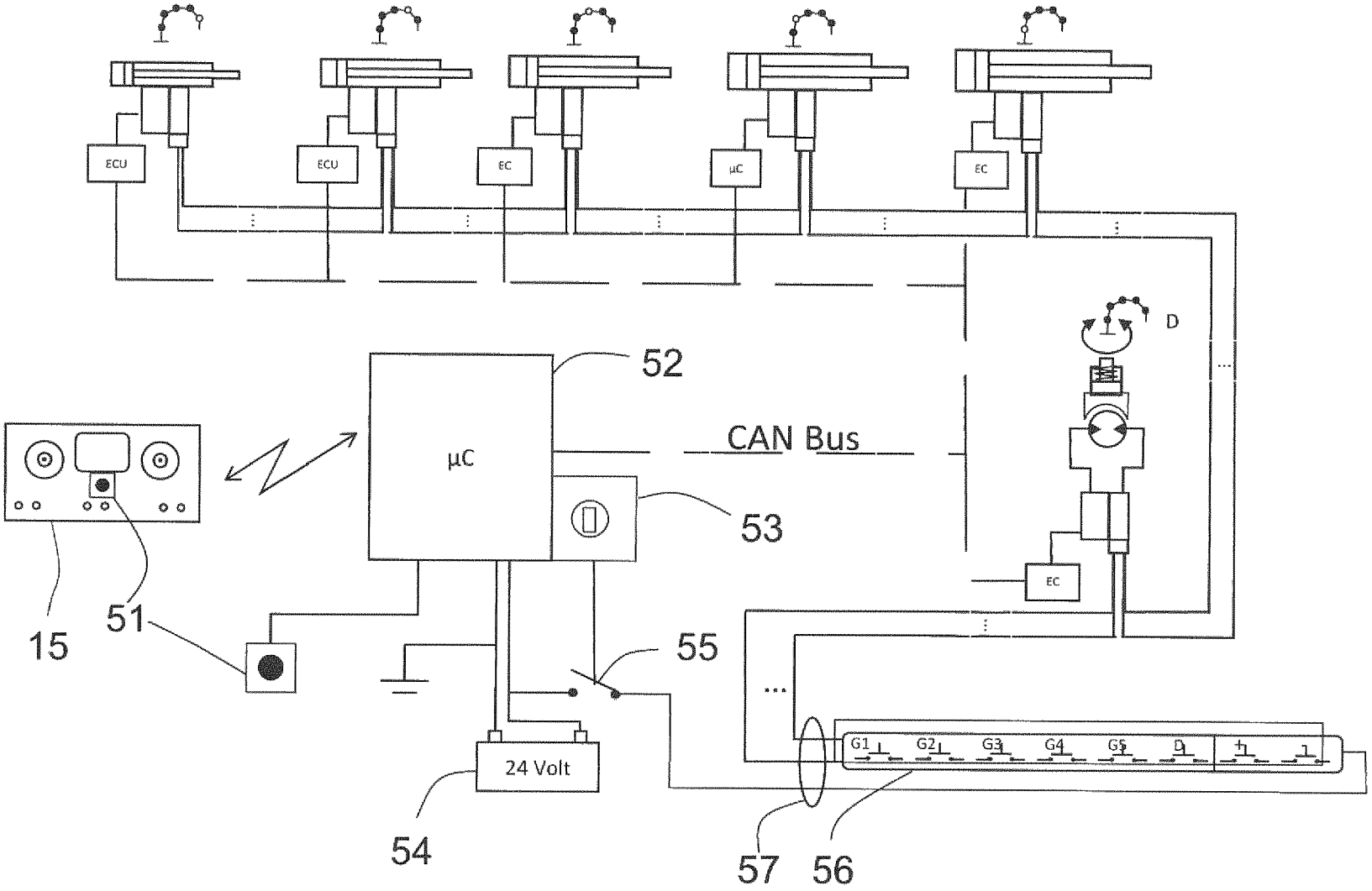

FIG. 5: a electrohydraulic control circuit according to the invention with emergency operating unit.

FIG. 1 shows an electrohydraulic control circuit 1 according to the invention for the actuating of hydraulically operated drive assemblies, FIG. 1 showing a total of five drive assemblies 2, 2*a*, 2*b*, 2*c*, 2*d* for driving the mast segments 3, 3*a*, 3*b*, 3*c*, 3*d* (FIG. 4). The drive assemblies 2, 2*a*, 2*b*, 2*c*, 2*d* enable a movement of the mast segments 3, 3*a*, 3*b*, 3*c*, 3*d* (FIG. 4) of the manipulator 4 (FIG. 4) in terms of their orientation. The drive assemblies 2, 2*a*, 2*b*, 2*c*, 2*d* can be driven in normal operation by means of a first hydraulic pressure supply unit 5, this operating condition being shown in FIG. 1. Here, the first pressure supply unit 5 supplies the drive assemblies 2, 2*a*, 2*b*, 2*c*, 2*d* via the pressure supply (P1) 24 with hydraulic pressure, in order to drive the drive assemblies 2, 2*a*, 2*b*, 2*c*, 2*d*. The first pressure supply (P1) 24 is shown by dotted lines in FIG. 1, while the first return flow (T1) 25 is shown by dot and dash lines. The hydraulic oil delivered by the first pressure supply unit 5 is distributed by means of the first pressure supply (P1) 24 via the main valve 18 to the individual mast segments 3, 3*a*, 3*b*, 3*c*, 3*d* (FIG. 4) and the drive assemblies 2, 2*a*, 2*b*, 2*c*, 2*d* arranged there. The first return flow (T1) 25 takes the hydraulic oil from the drive assemblies 2, 2*a*, 2*b*, 2*c*, 2*d* back to the tank 23, from which the hydraulic oil is again available for delivery through the hydraulic pump line 22. The hydraulic pump line 22 comprises, besides the first pressure supply unit 5, further pressure supply units 6, 8. The second pressure supply unit 6 in its first operating condition is switched to fill a hydraulic accumulator 7. The third pressure supply unit 8, which is used as an emergency pressure supply unit 8, in normal operation supplies an agitator 9 or its drive motor with hydraulic pressure. The individual drive assemblies 2, 2*a*, 2*b*, 2*c*, 2*d* are coordinated with their own proportional valves 28 (FIG. 3), which are arranged in parallel with each other on the first pressure supply (P1) 24 and on the first return flow (T1) 25. Preferably, the proportional valve 28 (FIG. 3) can be actuated with a step motor 31 (FIG. 3). With the proportional valve 28 (FIG. 3), the associated drive assembly 2, 2*a*, 2*b*, 2*c*, 2*d*, especially the hydraulic cylinder, can be extended in that the proportional valve 28 (FIG. 3) applies a pressure difference to the operating lines 29, 30 (FIG. 3) associated with the drive assembly 2, 2*a*, 2*b*, 2*c*, 2*d*. For this, the operating lines 29, 30 (FIG. 3) are arbitrarily connected to a first pressure supply (P1) 24 or to a first return flow (T1) 25 by the proportional valve 28 (FIG. 3). In FIG. 1 one may also see an emergency stop circuit with emergency stop valve 21 by which the hydraulic oil delivered by the pressure supply units 5, 6 can simply flow back to the tank 23 in an emergency. The emergency stop valve 21 is switched, for example, when one of the emergency stop buttons 51 (FIG. 5) is activated. The second pressure supply unit 6 has a downstream changeover 19 for its second operating condition, by which the delivered hydraulic oil can be switched from the hydraulic accumulator 7 of a piston pump to the first pressure supply (P1) 24. With the changeover of the second pressure supply unit 6 to the first pressure supply (P1) 24, the delivery volume can be boosted such that the drive assemblies 2, 2*a*, 2*b*, 2*c*, 2*d* swivel the mast segments 3, 3*a*, 3*b*, 3*c*, 3*d* (FIG. 4) such that the demanded speeds of the individual drive assemblies 2, 2*a*, 2*b*, 2*c*, 2*d* can be reliably achieved, even during simultaneous movement of several drive assemblies. In particular, the switching in of the second pressure supply unit 6 is advisable for the fast mounting and dismounting of the articulated mast 10 (FIG. 3), in order to be able to swivel the manipulator 4 (FIG. 4) in the range of the maximum possible speed. The emergency pressure supply unit 8 likewise has a downstream changeover 20, whereby in the emergency operation the delivered hydraulic oil can be switched away from the agitator 9, as a possible pressure receiver in the normal operation, to the emergency circuit (P2, T2) 26, 27. This emergency circuit 26, 27 makes possible a movement of the drive assemblies 2, 2*a*, 2*b*, 2*c*, 2*d* upon failure of the regular pressure supply (P1, T1) 24, 25. The drive assemblies 2, 2*a*, 2*b*, 2*c*, 2*d*, especially their hydraulic cylinders, can thus be moved in the emergency operation, in that the separate pressure supply (P2) 26 or the separate return flow (T2) 27 applies a pressure difference to the drive assemblies 2, 2*a*, 2*b*, 2*c*, 2*d*. For this, the operating lines 29, 30 (FIG. 3) are arbitrarily each connected to the second pressure supply (P2) 26 or a second return flow (T2) 27 by the control valve 36 for the emergency operation. In the emergency operation, the pressure supply of the drive assemblies 2, 2*a*, 2*b*, 2*c*, 2*d* comes from the emergency pressure supply unit 8 via the separate pressure supply (P2) 26 and the separate return flow (T2) 27, so that in event of a leak in the pressure supply (P1) 24 or the return flow (T1) 25, but also in event of a failure of the first pressure supply unit 5, an actuating of the drive assemblies 2, 2*a*, 2*b*, 2*c*, 2*d* is still possible. In this way, it can be assured that, upon failure of the regular pressure supply (P1, T1) 24, 25, the articulated mast 10 (FIG. 4) can still be moved, for example in order to retract the articulated mast 10 (FIG. 4) and possibly pump out the remaining concrete from the concrete pump and the delivery pipes.

FIG. 2 shows the electrohydraulic control circuit 1 from FIG. 1 in the emergency operation condition. The emergency pressure supply unit 8 is switched in across the changeover 20 of the separate pressure supply (P2) 26, shown in dashed lines, and supplies hydraulic pressure to the drive assemblies 2, 2*a*, 2*b*, 2*c*, 2*d*, thereby driving the drive assemblies 2, 2*a*, 2*b*, 2*c*, 2*d*. The return flow of the hydraulic oil runs across the second return flow (T2) 27, shown by dot and dash line. In this condition, a voltage supply to an emergency operating unit 56 (FIG. 5) is activated by means of a key switch 53 (FIG. 5) across a for example electrically actuated switch 55 (FIG. 5). The emergency operating unit 56 is connected by the switch 55 to a simple voltage source, such as the onboard battery 54 of the manipulator, which furnishes a constant voltage (FIG. 5) and comprises simple buttons and/or switches, by which on the one hand the bending joint 13, 13*a*, 13*b*, 13*c*, 13*d* (FIG. 4) or rotation mechanism 12 (FIG. 4) to be controlled for the articulated mast 10 (FIG. 4) is selected and on the other hand the travel direction is established for the selected bending joint 13, 13*a*, 13*b*, 13*c*, 13*d* (FIG. 4) or rotation mechanism 12 (FIG. 4) or the drive assembly 2, 2*a*, 2*b*, 2*c*, 2*d* (FIGS. 1 to 3). With this emergency operating unit 56 (FIG. 5), a simple and less fault-susceptible control system is provided for the emergency operation, since the emergency operating unit 56 (FIG. 5) is electrically robust. From the emergency operating unit 56 (FIG. 5) a twelve-strand interconnector leads to the emergency valves. With the activation of the buttons on the emergency operating unit 56 (FIG. 5), the 24 V voltage supply of an onboard battery 54 (FIG. 5) is applied to the electromagnetic emergency valve 36 to be respectively activated of the selected bending joint 13, 13*a*, 13*b*, 13*c*, 13*d* (FIG. 4) or rotation mechanism 12 (FIG. 4). The emergency operating unit 56 (FIG. 5) may be hard wired or cabled, or it may be connected across a plug connector, such as an option box, to the electrical system. Preferably, the emergency operating unit 56 (FIG. 5) is connected by a long cable 57 (FIG. 5) to the machine, so that the user with the emergency operating unit 56 (FIG. 5) can be at a distance from the manipulator and can watch the movements of the articulated mast, without needing the assistance of other persons therefor.

Alternatively, it is also conceivable to form the emergency control unit 56 (FIG. 5) from a switching mechanism mounted on the machine with a radio receiver, which is controlled by a further simple and separate radio remote control or the radio remote control system 15 which might be decoupled from the normal control system during emergency operation (FIGS. 4 and 5).

FIG. 3 shows a schematic representation of an electrohydraulic control circuit 1 for actuating a hydraulically operated drive assembly 2, by means of which a mast segment 3, 3*a*, 3*b*, 3*c*, 3*d* (FIG. 4) of a manipulator, especially a large manipulator for truck-mounted concrete pumps, can be adjusted in regard to its orientation, having an electrically actuated proportional valve 28, which is connected to the hydraulic operating lines 29, 30 of the drive assembly 2 for its actuation. For better visibility, only one detail of the control circuit 1 from FIGS. 1 and 2 is shown, which controls a drive assembly 2. The proportional valve 28 can be actuated with a step motor 31, wherein the proportional valve 28 contains a valve piston and a restoring spring. The actuation of the valve piston at the proportional valve 28 occurs via a toothed rack by means of the step motor 31. At the step motor 31 there is provided a monitoring unit for monitoring the positioning steps performed by the step motor 31. In order to determine the position in which the proportional valve 28 finds itself, a storage unit is furthermore provided, for storing the positioning steps performed by the step motor 31. The actuation by means of step motor 31 enables a very precise setting of the proportional valve 28 independently of the flow forces occurring, which makes possible an especially accurate control system of the drive assembly 2. Further, FIG. 3 shows the electrically actuated proportional valve 28 with which the drive assembly 2, and especially the hydraulic cylinder, can travel, in that the proportional valve 28 applies a pressure difference to the operating lines 29, 30 associated with the drive assembly 2. For this purpose, the operating lines 29, 30 are selectively connected respectively to a first pressure supply (P1) 24 or a first return flow (T1) 25 by the proportional valve 28. The actuation of the proportional valve 28 occurs across a coordinated step motor 31 by a local electronic control mechanism ECU (electronic control unit), which is designed to receive BUS data signals and to control the step motor of the proportional valve. The local electronic control mechanism (ECU) monitors the condition of the local system via sensors connected to it (such as the pressure sensors 32*a*, 32*b*), makes possible the implementing of complex algorithms, and provides an interface for communication with the outside, especially with a central control unit 52 across a bus system (preferably CAN). The connection of the sensors may be either analog or via a further local BUS system (especially CAN). The local processing of the sensor data has the advantage that this reduces the electrical connection lines to a central control unit 52 (FIGS. 4 and 5) as well as the workload of the BUS system connecting the local control mechanism (ECU) to the central control unit 52 (FIGS. 4 and 5). For the supply of the local control mechanism (ECU) with energy, several voltage supplies are provided, wherein a first voltage supply (U1) supplies the local control mechanism (ECU) and at least one second voltage supply (U2) supplies the outputs at the local control mechanism (ECU). During an emergency stop, triggered by an emergency stop button 51 (FIG. 5) situated on the machine or by the detection of a serious fault by the local control mechanism (ECU) or the central control unit 52 (FIGS. 4 and 5), the following steps are taken: the hydraulic oil flow is rerouted across the emergency stop valve 21 (FIGS. 1 and 2) to the tank 23 (FIGS. 1 and 2), and furthermore all hydraulic supplies for the operation of the concrete pump are switched off or rerouted to the tank 23 (FIGS. 1 and 2). Moreover, the second voltage supply (U2) is switched off, so that the outputs of the local control mechanism (ECU) are without power, and all valves switch to a safe condition, so that no movement of the mast can occur. In this fault situation, for the salvaging or folding up of the mast, a changeover to the emergency operation may occur with the key switch 53 (FIG. 5), so that the emergency operating unit 56 (FIG. 5) is supplied with voltage from an onboard battery 54 (FIG. 5) by a switch 55 (FIG. 5). Furthermore, the emergency operation may be activated if one of the drive assemblies 2, 2*a*, 2*b*, 2*c*, 2*d* or the rotation mechanism 12 (FIG. 4) cannot be moved on account of a fault in the normal operation. Here again a changeover to the emergency operation may occur with the key switch 53 (FIG. 5), which likewise has the result that the second voltage supply (U2) is switched off, so that the outputs of the local control mechanism (ECU) are without power.

In normal operation, depending on the position of the proportional valve 28, a supply pressure associated with the pressure supply (P1) 24 is switched to an operating line 29 or 30 of the associated drive assembly 2. The check valves 33, 33*a* perform a load holding function when the control circuit 1 is in an inactive condition or a secured condition. The check valve 38 likewise has a safety function, in particular it prevents a pressing on the check valves 33, 33*a* in event of a stuck valve piston outside the center position in the proportional valve 28. The check valves 33, 33*a* and 38 are preferably designed as hydraulically releasable non-return valves, which are opened indirectly by means of an electrically actuatable switching valve 37. Furthermore, pressure sensors 32, 32*a* 32*b* are provided, which measure the supply pressure in the active condition of the control circuit 1 and the pressures acting on the drive assembly 2. The electrohydraulic control circuit 1 furthermore comprises, in the depicted embodiment, a hydraulic emergency circuit switched in parallel with the proportional valve 28 for the emergency operation. This emergency circuit makes possible a movement of the drive assembly 2 upon failure of the components associated (upstream or downstream) with the proportional valve 28. Each proportional valve 28 for the control system of a drive assembly 2, 2*a*, 2*b*, 2*c*, 2*d* is preferably associated with its own emergency circuit. The emergency circuit comprises a control valve 36 for the actuating of the travel direction of the drive assembly 2 in the emergency operation and two oppositely coupled valves 35, 35*a*, which are designed as hydraulically releasable nonreturn valves or lowering brake valves 35, 35*a* in a classical hook-up. With the downstream adjustable flow regulating valves 34, 34*a*, the travel speed can be adjusted during emergency operation. The drive assembly 2, especially the hydraulic cylinder, may thus be moved in the emergency operation, in that the control valve 36 applies a pressure difference to the operating lines 29, 30 associated with the drive assembly 2 for the emergency operation. For this purpose, the operating lines 29, 30 are selectively connected respectively to a second pressure supply (P2) 26 or a second return flow (T2) 27 by the control valve 36. In the emergency operation, the pressure supply of the drive assembly 2 comes preferably via the separate pressure supply (P2) 26 and the separate return flow (T2) 27, so that in event of a leak in the pressure supply (P1) 24 or the return flow (T1) 25 a control of the drive assembly 2 continues to be possible. In this way, it can be ensured that, upon failure of the regular mast actuation and proportional valve 28 of the articulated mast 10 (FIG. 4), a movement is still possible, for example in order to retract the articulated mast 10 (FIG. 4) and possibly pump out the remaining concrete from the concrete pump and the delivery pipes. The local electronic control mechanism (ECU) for this purpose monitors the condition and the behavior of the control circuit 1 by means of the available sensors. As soon as the local electronic control mechanism (ECU) detects a fault, it automatically switches the control circuit 1 to a safe condition. For this, preferably the proportional valve 28 and, via the switching valve 37, the nonreturn valves 33, 33*a*, 38, are switched to a safe condition, also in particular in event of failure of the voltage supply. The actuation of the local electronic control mechanism (ECU) may occur via a BUS system, which transmits control commands and target values that can be put in by a user, preferably via a user interface, such as the remote control device 15 (FIG. 4), and relayed to the central control unit 52 (FIGS. 4 and 5), which passes these on to the local electronic control mechanisms (ECU), in some circumstances in a processed manner.

FIG. 4 shows schematically a manipulator 4 according to the invention, especially a large manipulator for truck-mounted concrete pumps, with foldout articulated mast 10, having a turntable 12 rotatable about a vertical axis 11 and a plurality of mast segments 3, 3*a*, 3*b*, 3*c*, 3*d*. The mast segments 3, 3*a*, 3*b*, 3*c*, 3*d* in the sample embodiment are a total of five pieces, and they can each swivel at bending joints 13, 13*a*, 13*b*, 13*c*, 13*d* about bending axes with respect to an adjacent mast segment 3, 3*a*, 3*b*, 3*c*, 3*d* or the turntable 12. For this purpose, each time a drive assembly 2, 2*a*, 2*b*, 2*c*, 2*d* (FIGS. 1 to 3) is arranged at the mast segments 3, 3*a*, 3*b*, 3*c*, 3*d* in the bending joints 13, 13*a*, 13*b*, 13*c*, 13*d*. For the actuation of the drive assemblies 2, 2*a*, 2*b*, 2*c*, 2*d* (FIGS. 1 to 3), a central control unit 52 is provided, which converts a travel command, indicating a desired movement direction and travel speed of the mast tip 14 of the articulated mast 10 or an end hose mounted thereon, into actuating signals for the drive assemblies 2, 2*a*, 2*b*, 2*c*, 2*d* (FIGS. 1 to 3). With the control lever 16 on the remote control device 15, which can be moved in several positioning directions, corresponding travel commands can be generated. For this purpose, the control lever 16 is moved in a positioning direction, and the central control unit 52 receives the generated travel command. The central control unit 52 then converts the travel command into actuating signals for the drive assemblies 2, 2*a*, 2*b*, 2*c*, 2*d* (FIGS. 1 to 3). These actuating signals are received by the local control mechanism (ECU) and converted into switching signals for the respective proportional valve 28 (FIG. 3) or its step motor 31 (FIG. 3). With the travel command, the desired travel speed is also dictated. In order to be able to realize higher travel speeds, the central control unit 52 switches in the further pressure supply unit 6 (FIGS. 1 and 2) to the first pressure supply unit 5 (FIGS. 1 and 2) for the driving of the drive assemblies 2, 2*a*, 2*b*, 2*c*, 2*d* (FIGS. 1 to 3), this preferably occurring automatically. The control unit can be switched between multiple operating conditions, the automatic switching in of the further pressure supply unit 6 (FIGS. 1 and 2) preferably occurring only in a special operating condition. This special operating condition is selected by the user, especially during the folding up and folding out of the articulated mast 10, in order to be able to make optimal use of the maximum possible or permissible speeds for the drive assemblies 2, 2*a*, 2*b*, 2*c*, 2*d* (FIGS. 1 and 2) and thus save time during the erecting of the mast.

LIST OF REFERENCE NUMBERS

1 Control circuit
2 2*a*, 2*b*, 2*c*, 2*d* Drive assemblies
3*a*, 3*b*, 3*c*, 3*d* Mast segments
4 Manipulator
5 First pressure supply unit
6 Second pressure supply unit
7 Hydraulic accumulator
8 Emergency pressure supply unit
9 Agitator
10 Articulated mast
11 Vertical axis
12 Turntable
13 13*a*, 13*b*, 13*c*, 13*d* Bending joints
14 Mast tip
15 Remote control device
16 Control lever
17 Control system
18 Main valve
19 Changeover A
20 Changeover B
21 Emergency stop valve
22 Hydraulic pump line
23 Tank
24 Pressure supply (normal operation)
25 Return flow (normal operation)
26 Pressure supply (emergency operation)
27 Return flow (emergency operation)
28 Proportional valve
29 Operating line A
30 Operating line B
31 Step motor
32 32*a*, 32*b* Pressure sensors
33 33*a* Load holding/check valves
34 34*a* Adjustable flow regulating valves
35 35*a* Lowering brake (nonreturn) valves
36 Control valve (emergency operation)
37 Switching valve
38 Check valve
51 Emergency off switch
52 Central control system
53 Key switch
54 Onboard battery
55 Emergency operation changeover switch
56 Emergency control unit,
57 Cable
ECU Control mechanism
U1 First voltage supply
U2 Second voltage supply

The invention claimed is:

1. An electrohydraulic control circuit comprising:

a hydraulically-operated drive assembly including an electrically-actuated proportional valve and hydraulic operating lines, the proportional valve is connected to the hydraulic operating lines for actuation of the drive assembly in a normal operation mode, the proportional valve is also connected to a pressure supply line and to a return line; and an emergency valve that is connected to the hydraulic operating lines for actuation of the drive assembly in an emergency operation mode, wherein, in the emergency operation mode, the emergency valve is actuated via an emergency operating unit, which is connected to a voltage supply and the emergency valve, wherein the voltage supply provides a constant voltage and the emergency valve is actuated with the constant voltage.

2. The control circuit of claim 1, wherein the proportional valve and the emergency valve are arranged directly on the drive assembly to be controlled.

3. The control circuit of claim 1, wherein the emergency operating unit is connected by a movable cable to the voltage supply and to the emergency valve.

4. The control circuit of claim 1, wherein the emergency operating unit is activated for the emergency operation mode with a key switch.

5. The control circuit of claim 1, wherein the proportional valve is actuated with a step motor.

6. The control circuit of claim 5, wherein a control mechanism is arranged on the drive assembly to receive BUS data signals from a BUS data link and to control the step motor.

7. The control circuit as claimed in claim 6, wherein a voltage supply of outputs of the control mechanism is switched off during a changeover to the emergency operation mode.

8. The control circuit of claim 7, wherein several separate voltage supplies lead to the control mechanism, wherein at least a first voltage supply supplies the control mechanism and at least a second voltage supply supplies the outputs at the control mechanism.

9. The control circuit of claim 1, wherein the emergency valve is connected to an additional pressure supply line and to an additional return line.

10. An electrohydraulic control circuit comprising:

a hydraulically-operated drive assembly including an electrically-actuated proportional valve and hydraulic operating lines, the proportional valve is connected to the hydraulic operating lines for actuation of the drive assembly in a normal operation mode, the proportional valve is also connected to a pressure supply line and to a return line; and an emergency valve that is connected to the hydraulic operating lines for actuation of the drive assembly in an emergency operation mode, wherein, in the emergency operation mode, the emergency valve is actuated via an emergency operating unit, the emergency operating unit including switches and/or buttons arranged on the emergency operating unit, wherein the emergency valve is supplied with voltage by a voltage supply by activating at least one of the switches and/or buttons in order to actuate the drive assembly.

11. The electrohydraulic control circuit of claim 10, wherein the emergency operating unit is connected by a movable cable to the voltage supply and to the emergency valve.

12. The electrohydraulic control circuit of claim 10, wherein the proportional valve is actuated with a step motor.

13. The electrohydraulic control circuit of claim 12, wherein a control mechanism is arranged on the drive assembly to receive BUS data signals from a BUS data link and to control the step motor.

14. The electrohydraulic control circuit of claim 10, wherein the proportional valve and the emergency valve are arranged directly on the drive assembly to be controlled.

15. An electrohydraulic control circuit comprising:

a hydraulically-operated drive assembly including an electrically-actuated proportional valve and hydraulic operating lines, the proportional valve is connected to the hydraulic operating lines for actuation of the drive assembly in a normal operation mode, the proportional valve is also connected to a pressure supply line and to a return line; and an emergency valve that is connected to the hydraulic operating lines for actuation of the drive assembly in an emergency operation mode, wherein, in the emergency operation mode, the emergency valve is actuated via an emergency operating unit, which is connected to a voltage supply and to the emergency valve, wherein the emergency operating unit is activated for the emergency operation mode with a key switch.

16. The electrohydraulic control circuit of claim 15, wherein the emergency operating unit is connected by a movable cable to the voltage supply and to the emergency valve.

17. The electrohydraulic control circuit of claim 15, wherein the proportional valve and the emergency valve are arranged directly on the drive assembly to be controlled.

18. The electrohydraulic control circuit of claim 15, wherein the proportional valve is actuated with a step motor.

19. The electrohydraulic control circuit of claim 15, wherein a control mechanism is arranged on the drive assembly to receive BUS data signals from a BUS data link and to control the step motor.

20. The electrohydraulic control circuit of claim 15, wherein a voltage supply of outputs of the control mechanism is switched off during a changeover to the emergency operation mode.

* * * * *